US011808419B1

(12) United States Patent
Chen

(10) Patent No.: US 11,808,419 B1
(45) Date of Patent: Nov. 7, 2023

(54) INDIRECT LIGHTING FIXTURE WITH A SINGLE SIDE LIGHT

(71) Applicant: Xiong Chen, Irvine, CA (US)

(72) Inventor: Xiong Chen, Irvine, CA (US)

( * ) Notice: Subject to any disclaimer, the term of this patent is extended or adjusted under 35 U.S.C. 154(b) by 0 days.

(21) Appl. No.: 18/170,850

(22) Filed: Feb. 17, 2023

(51) Int. Cl.
*F21S 4/28* (2016.01)
*F21V 7/00* (2006.01)

(52) U.S. Cl.
CPC ..... *F21S 4/28* (2016.01); *F21V 7/005* (2013.01); *F21V 7/0008* (2013.01)

(58) Field of Classification Search
CPC ..... F21S 4/28; F21V 7/0008; F21V 7/005
See application file for complete search history.

(56) References Cited

U.S. PATENT DOCUMENTS 7,591,578 B2 * 9/2009 Chang ..... G02F 1/133602 362/633
7,922,354 B2 4/2011 Everhart
8,579,473 B2 11/2013 Holten et al.
8,905,575 B2 12/2014 Durkee et al.
9,699,856 B2 7/2017 Roberts
9,726,337 B2 * 8/2017 Hedberg, Jr. ..... F21S 8/026
10,208,905 B2 2/2019 Lavin et al.
10,208,933 B1 2/2019 Seligman et al.
10,584,860 B2 3/2020 Dungan et al.
10,760,749 B2 9/2020 Lavin et al.
10,801,695 B2 10/2020 Jiao et al.
2012/0051041 A1 3/2012 Edmond
2013/0021803 A1 * 1/2013 Pickard ..... F21V 7/0008 362/296.01
2014/0226328 A1 * 8/2014 Schwarz ..... F21V 17/164 362/235
2014/0268721 A1 * 9/2014 Durkee ..... F21S 8/04 362/218
2016/0061413 A1 * 3/2016 Hedberg, Jr. ..... F21V 7/06 362/147
2016/0076733 A1 * 3/2016 Eustace ..... F21V 21/30 362/247

* cited by examiner

*Primary Examiner* — Evan P Dzierzynski
(74) *Attorney, Agent, or Firm* — Clement Cheng

(57) ABSTRACT

An indirect lighting fixture has a main body. An LED strip has LED chips mounted to the LED strip. The LED strip is mounted at a strip orientation plane. The reflector has a reflector channel profile which extends between a strip orientation plane and a housing orientation plane. A housing orientation plane is defined on a horizontal plane. A strip orientation plane is defined according to the LED strip. A strip orientation angle is defined between the housing orientation plane and the strip orientation plane. The strip orientation angle is between 90 and 145 degrees. It is an indirect lighting fixture designed with a single bar light source, its direct light is invisible. The light changed from the hot spot strip light to the panel light.

15 Claims, 6 Drawing Sheets

INDIRECT LIGHTING FIXTURE WITH A SINGLE SIDE LIGHT

FIELD OF THE INVENTION

The present invention is in the field of indirect lighting fixtures.

BACKGROUND

The light output types of current lighting fixtures are basically direct light, and some of them adopt side light emission mode. Of course, there are very few indirect lighting fixtures on the market that use bottom emission and use reflective coatings to reflect light.

The light source of the direct light-emitting lighting fixture is concentrated on the upper part of the fixture, and the light source is densely concentrated in a point area or a strip area. The light source area is relatively small, high brightness, and it is easy to form glare. There is a greater stimulus. In addition, some direct light-emitting lighting fixtures will install a diffuser plate, grille or fog cover at the light outlet to reduce the glare value, but these additions will block and lose part of the light.

The principle of side-emitting lighting fixtures is to place the light source on the side, pass the light through the light guide plate and the reflector plate, guide and reflect the light, and then emit it through the diffuser plate. It requires a multi-layer structure design, the loss of light efficiency is large, and the durability of the light guide plate is also common.

In the existing indirect lighting fixtures, reflective design is carried out by spraying a reflective coating on the inner surface of the exterior components. The light reflection efficiency of the reflective coating is low, and the optical structure is not optimized, resulting in low light efficiency of the overall lamp. This type of product is not common in the market.

Therefore, it is necessary to develop a class of lighting fixtures that can achieve high light extraction efficiency, have no strong light spots and no direct light, are friendly to human eyes, and can reduce glare. Our invention is to irradiate the light of the single-sided strip light source to the surface of the plastic material with high reflection and diffuse reflection characteristics, and then emit it again after reflection and diffuse reflection. In this design, the original light source point is hidden through structural design, and the light output point is changed from a point light source to a surface light source. It converts the light of a single-sided strip light source into the light of a surface light source after reflection, achieving high-efficiency indirection illumination! It can effectively reduce the intensity of light output per unit area, increase the angle of light output, and reduce the intensity of shadows under occluders.

DISCUSSION OF RELATED ART

A variety of different indirect lighting configurations have been used in the industry, such as described in United States patents. For example, in Holten U.S. Pat. No. 8,579,473, issued Nov. 12, 2013 entitled Luminaire for Indirect Illumination, the inventor describes, "The luminaire further comprises a specularly reflective part (43) as part of the reflective screen, which specularly reflective part is concavely shaped for reflecting at least part of the light emitted by the light source towards a diffusely reflective part (42) of the reflective screen."

Also, for example, in Lavin, U.S. Pat. No. 10,208,905, issued Feb. 19, 2019 entitled Recessed Lighting Fixtures for Efficiently Providing Aesthetically Pleasing Indirect Lighting and U.S. Pat. No. 10,760,749, issued Sep. 1, 2020, entitled Recessed Lighting Fixtures for Efficiently Providing Aesthetically Pleasing Indirect Lighting, the inventor describes that, "A recessed light fixture configured to deliver indirect light to an area. The recessed light fixture includes a trim component, a reflector coupled to the trim component, and an annular ring including a plurality of light-emitting diodes (LEDs). The trim component has an outer wall and an inner wall spaced radially inward of the outer wall, and defines an annular recess between the outer and inner walls. The reflector includes a patterned reflective surface. The annular ring is arranged within the annular recess of the trim component. The LEDs are configured to emit light toward the reflector so that the reflector redirects the light to deliver the indirect light to the area."

Another example shown in U.S. Pat. No. 10,801,695, issued Oct. 13, 2020 entitled Lamp, the inventor describes, "The reflection hood (110) is made of diffuse reflection material, is a curved face formed by the translation of an elliptic arc, and has a light emitting outlet (114), and an inner surface thereof is a reflection face (112). The light source assembly (120) is fixed to an end of the reflection face (112) and the included angle between a tangent line, at the point of intersection of a central light emitted therefrom and the reflection face (112), and the central light is 130° to 170°."

In U.S. Pat. No. 7,922,354, issued Apr. 12, 2011 entitled Solid-State Lighting Fixtures, the inventor describes, "A high performance, high efficiency solid state electronic lighting device, having a sealed fixture body for use outdoors or in environments requiring IP rated sealed fixtures, uses light emitting diodes for producing light from AC current that operates on an as needed basis dependent upon occupancy, ambient light levels and facility load requirements."

Another significant example showed in U.S. Pat. No. 8,905,575, issued Dec. 4, 2014, entitled Troffer-Style Lighting Fixture with Specular Reflector, the inventor describes "An elongated heat sink with a mount surface for light sources runs longitudinally along the fixture. To facilitate heat dissipation, a portion of the heat sink is exposed to the ambient room environment. An elongated specular reflector also runs along the device proximate to the heat sink. The heat sink and the specular reflector are mounted such that a spatial relationship is maintained. Some of the light from the sources impinges directly on the specular reflector and is redirected towards a back surface. The back surface defines a luminous surface that receives light directly from the sources and redirected light from the specular reflector." As documented in U.S. Pat. No. 9,699,856, issued Jul. 4, 2017, entitled Upgradeable Lighting Fixture, the inventor describes "The lens is supported by and attached to the outer frame. The solid-state light source is mounted to the outer frame and at least partially surrounded by the lens, such that at least a portion of the light provided by the solid-state light source is transmitted through the lens towards an area of interest.

As seen in US Patent 2012/0051041, issued Mar. 1, 2012, entitled Troffer-Style Fixture, the inventor describes "The troffer comprises a light engine unit that is surrounded on its perimeter by a reflective pan. A back reflector defines a reflective interior surface of the light engine."

Another example shown in U.S. Pat. No. 10,208,933, issued Feb. 19, 2019, entitled Adjustable Light Fixture and Lighting System, the inventor describes "A housing is selectively adjustable to a selected housing length and is mountable to the surface. A tray mountable to the housing includes plates which are selectively adjustable relative to one another to a selected tray length. Each plate includes a plurality of electroluminescent light sources providing uniformly luminous light across the light fixture. Overlap of plates varies the tray length and blocks light from light sources on one plate by the opposite plate."

One final example shown in U.S. Pat. No. 10,584,860, issued Mar. 10, 2020, entitled Linear Light Fixture with Interchangeable Light Engine Unit, the inventor describes "The lighting subassembly comprises the light sources and optical elements that tailor the light to achieve a particular profile. Electronics necessary to power and control the light sources may be disposed in the housing subassembly, the lighting subassembly, or both."

The foregoing references that are incorporated herein by reference relate to indirect lighting solutions that attempt to produce a uniform light. However, some of the structures can still be improved.

SUMMARY OF INVENTION

According to the above background and requirements, our innovation mainly irradiates the light of the bar-shaped light source of the bar-shaped lighting fixtures widely existing in existing lamps to a larger area of plastic material surface with high-efficiency reflection and diffuse reflection characteristics.

In this way, it changes the light from a concentrated point to an indirect surface light after being reflected by the surface of the plastic material, thereby reducing the light intensity per unit area of the light, and changing the light at the source point from direct light to an indirect light.

In order to achieve the complete indirect light and prevent the eyes from seeing direct light, we need to make a structure and increase the edge design when designing, and at the same time, try to maintain a high light output effect. Realize the indirect lighting of light and reduce the unit light intensity to bring low glare value, expand the light angle of the lamp, can reduce the shadow intensity after the light is blocked, let the traditional lamp have a different appearance, and let the traditional lamp have a new direction, so that consumers have a new choice whether it is function or appearance.

This embodiment contains the following parts:

An indirect lighting fixture has a main body. An LED strip has LED chips mounted to the LED strip. The LED strip is mounted at a strip orientation plane. The reflector has a reflector channel profile which extends between a strip orientation plane and a housing orientation plane. A housing orientation plane is defined on a horizontal plane. A strip orientation plane is defined according to the LED strip. A strip orientation angle is defined between the housing orientation plane and the strip orientation plane. The strip orientation angle is between 90 and 145 degrees.

If the reflector is deeper, then the range of the strip orientation can change and be up to 145° or more. The current aspect ratio of the reflector is preferably 2:1 with a width that is approximately twice as large as the thickness. If the reflector is deeper, the reflector apex angle is maintained such that the strip orientation plane can be modified. In such a case, for deeper reflectors having a different aspect ratio, the strip orientation angle can be up to 145° or more.

The LED strip is mounted to the strip backer panel, and the LED strip is parallel to the strip backer panel. The horizontal plane is parallel to the main body. The main body has a horizontal lower surface. The shading panel is angled upwardly and extends away from a lower edge of the LED strip, it is responsible for blocking the direct light of the LED light source and preventing the direct light from being directly emitted to the outside of the indirect lighting fixuture. The reflector channel profile has a reflector apex. The strip orientation plane is at a right angle to an LED chip midline. The reflector apex is illuminated by the LED chip at an LED chip apex line. The LED chip apex line extends from the LED chip to the reflector apex. The LED chip apex extended line and the LED chip midline form a reflector apex angle. The reflector apex angle is acute and 25°±25°. It depends on the depth of the reflector's curve. In this innovation, under some cases, the part of reflector will be designed to be used to reflect the light to other part of reflector, the shape of the lighting fixtures will be different, the angle degree also will be different.

A contour lens can be covered on the chip of light source. It can be made by glass or plastic. It has a lens extension contour. The lens extension contour can change the light line range and width. It help to let the all of the lights of the light source to emit to the reflector surface, it will improve the efficiency. It is an option for this innovation.

The main body maybe further includes a secondary reflector panel on the shading panel. To add the secondary reflector on the shading panel also is a option for the innovation. Under some cases it can improve the electro-optic conversion efficiency by 3-5% or more.

In this innovation, it has a cover (Shade) over the LED strip. The cover is made of plastic or glass. This cover can diffuse the light and helps to reduce and eliminate yellow or colored light around the edge of the light outlet. It also is a option for this innovation, but most cases need it.

Figure 1:
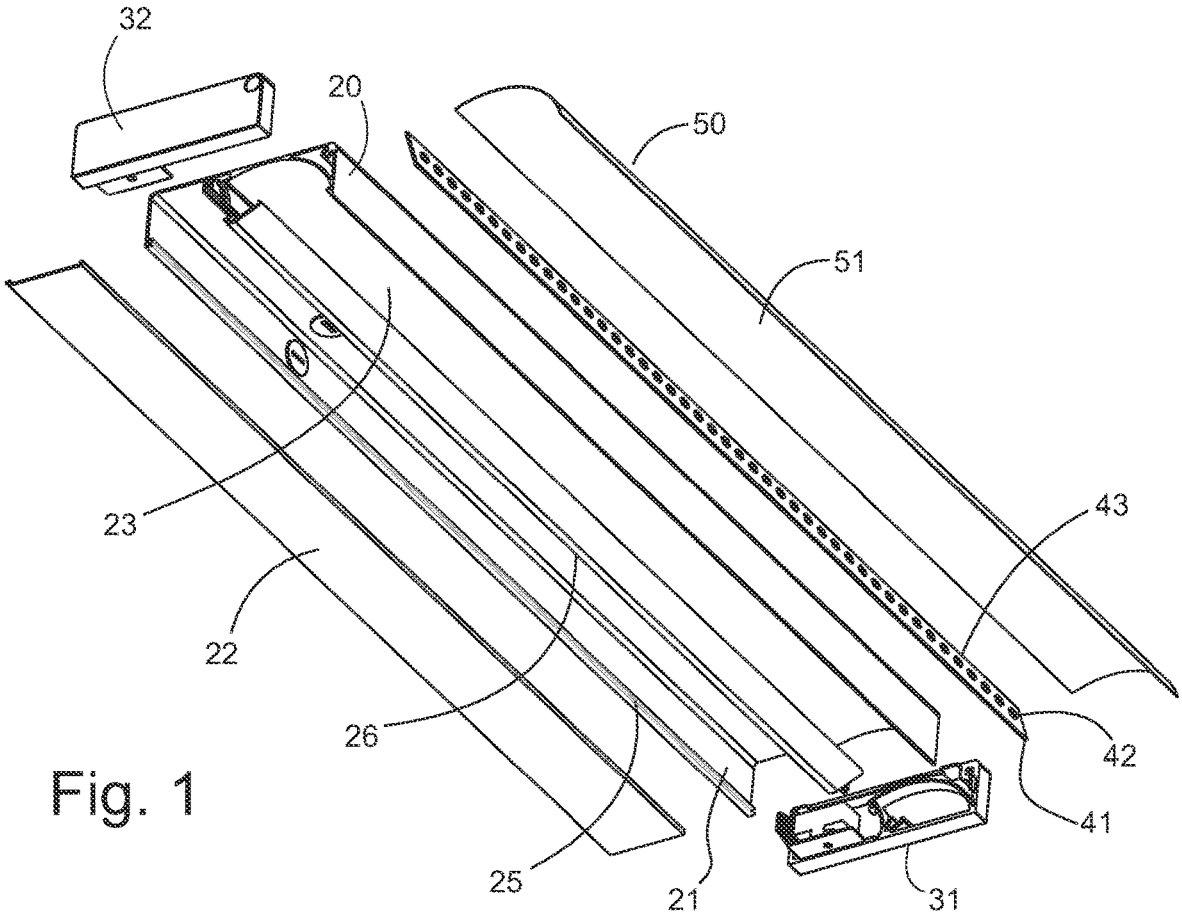
FIG. 1 shows a lower perspective view of an indirect undercabinet light.

The following call out list of elements can be a useful guide in referencing the element numbers of the drawings.

20 main body
21 housing channel
22 cover panel
23 reflector channel
24 knockout opening
rear cover slot
26 front cover slot
28 reflector panel rear slot
29 front triangular channel
30 end cap
31 right end cap
32 left end cap

33 connector opening
34 long connector flange
35 short connector flange
40 power supply
41 LED strip
42 LED chip
43 cover (Shade) of the LED strip
44 lower edge of LED strip
45 upper edge of LED strip
50 reflector panel
51 surface of reflector panel
60 reflector channel profile
61 reflector proximal curve
62 reflector distal curve
63 LED strip backer panel
64 inside strip retainer
65 inside strip retainer channel
66 outside strip retainer channel
67 outside strip retainer
68 shading panel
69 shading panel extension tip
70 geometric configuration
71 housing orientation plane
72 strip orientation plane
73 strip orientation angle
81 reflector apex angle
82 reflector apex midline
83 LED chip midline
84 LED chip apex extended line
85 midline junction
86 right emission line
87 left emission line
88 reflector apex
89 emission angle
90 contour lens
91 right side of left corner emission line
92 LED chip left corner
93 lens extension
94-lens extension contour
95 light profile
96 main body shape tip
97 extension tip shade line
101 electrical connector
102 PCB end slot
103 front retainer tab
104 top retainer tab
105 rear retainer tab
106 modular retainer rail
107 secondary reflector panel

DETAILED DESCRIPTION OF THE PREFERRED EMBODIMENT

According to this innovative design of indirect lighting using a single-side light source, we will specifically illustrate it with an embodiment of an undercabinet indirect light.

As seen in FIG. 1, the undercabinet light has a main body 20. The main body is preferably an aluminum extrusion that can be powder coated or painted for surface finish. The main body has a housing channel 21 and a reflector channel 23. The housing channel 21 retains the power supply and electrical cables. The cover panel 22 fits over the housing channel and retains to a front cover slot 26 and a rear cover slot 25 formed on the housing channel 21. The housing channel 21 preferably retains the power supply, for clarity not shown.

The housing channel 21 has the same length as the reflector channel 23, but the housing channel 21 is narrower than the reflector channel 23. The main body 20 also receives a right end cap 31 and a left end cap 32. The reflector panel 50 fits to the main body 20. The reflector panel 50 is made by plastic material that can reflect and diffuse light. These plastic material are PET or PC or other styles material. Some diffuse reflecting plastic materials are foamed PET, foamed polycarbonate, Styrofoam, etc. Especially the reflector panel 50 can be made by a single sheet of foaming material that has micro plastic balls for refraction of light. The surface of reflector panel 51 can reflect and diffuse light. The reflector panel 50 reflects light emitted from LED chips 42 that are mounted on an LED strip 41. The LED chips 42 are connected that used the circuit in the LED strip 41. The LED strip 41 can be formed as a printed circuit board.

Figure 2:
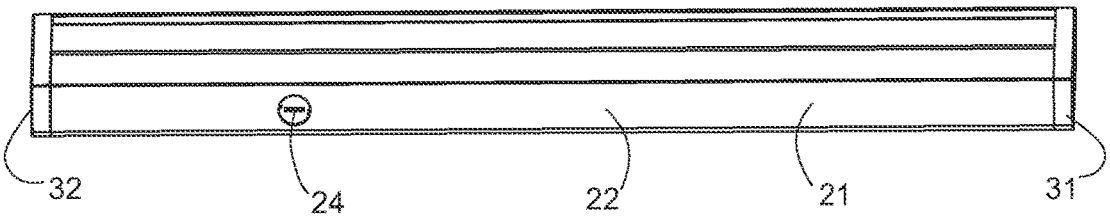
FIG. 2 shows a rear perspective view.

As seen in FIG. 2, the main body has a knockout opening 24 to provide a wired electrical connection to electrical components within the housing channel 21.

Figure 3:
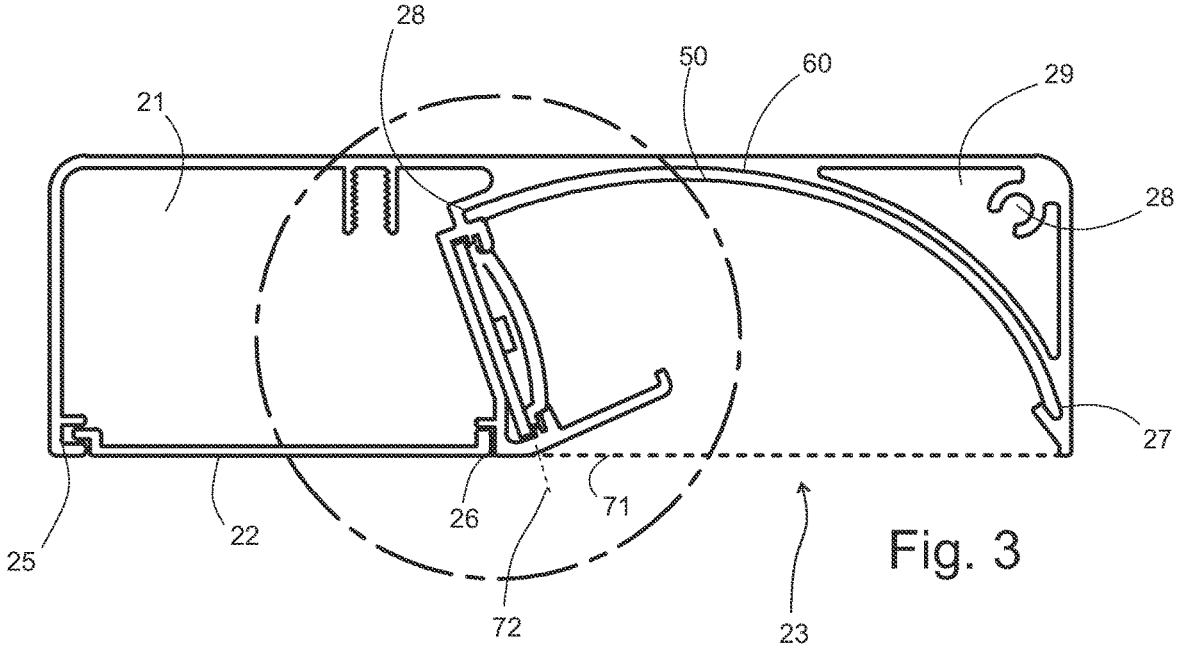
FIG. 3 shows a cross-section view.

As seen in FIG. 3, the reflector channel 23 has a reflector channel profile 60. The reflector channel profile 60 is curved and has a reflector proximal curve 61 and a reflector distal curve 62. The reflector panel 50 is retained between a pair of slots. A reflector panel rear slot 28 and a reflector panel from slot 27 retain the reflector panel and bias the reflector panel so that the reflector panel 50 conforms to the reflector channel profile 60 of the main body 20.

The main body 20 has a front triangular channel 29 that includes a screw connector channel 28. The front triangular channel 29 defines a profile for the reflector channel. The housing orientation plane 71 is defined along a lower edge of the main body 20. The main body 20 has a generally flat lower surface.

The printed circuit is in the LED strip 41 that mounted and connected with all of LED chips 42.

Figure 4:
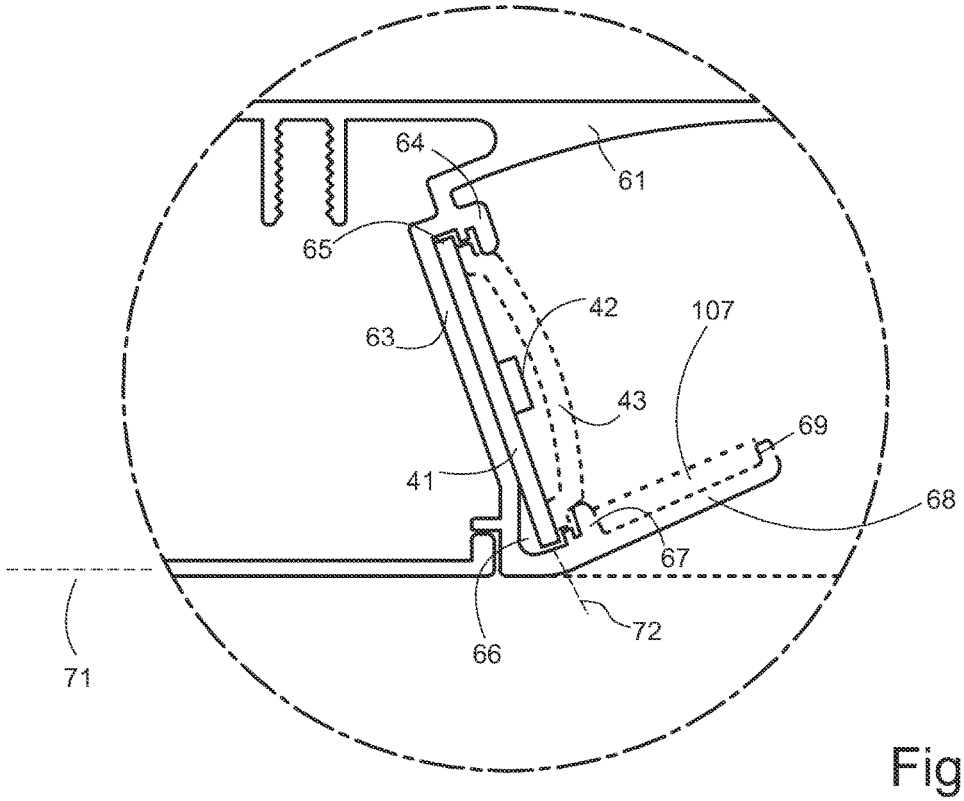
FIG. 4 shows an enlarged cross-sectional view.

As seen in FIG. 4, the reflector proximal curve 61 over the main body 20 bends downwardly toward an LED strip backer panel 63. The LED strip backer panel send extends to a shading panel 68. The shading panel 68 extends from the outside strip retainer 67 and terminates at a shading panel extension tip 69. The shading panel 68 and the reflector proximal curve 60 can have protruding retainers that secure the LED strip and the LED strip lens or the cover (Shade) of the LED strip 43. The LED strip cover 43 securities between the inside strip retainer 64 and the outside strip retainer 67. The LED strip backer panel 63 is a heat sink that uses the reflector proximal curve 61 and shading panel 68 as fins via thermal conduction. The LED strip 41 secures to the LED strip backer panel 63 and fits between the inside strip retainer channel 65 and the outside strip retainer channel 66. The strip orientation plane 72 is angled.

The main body 20 is formed so that the housing orientation plane 71 is angled from the strip orientation plane 72. The outside strip retainer channel 66, the inside strip retainer channel 65 and the shading panel 68 are angled slightly upwardly as they are aligned with the LED strip 41. The shading panel 68 of the main body 20 can optionally be added on a secondary reflector panel 107. Also the shading panel 68 can be painted white or has a reflective coating on its inside surface.

Figure 5:
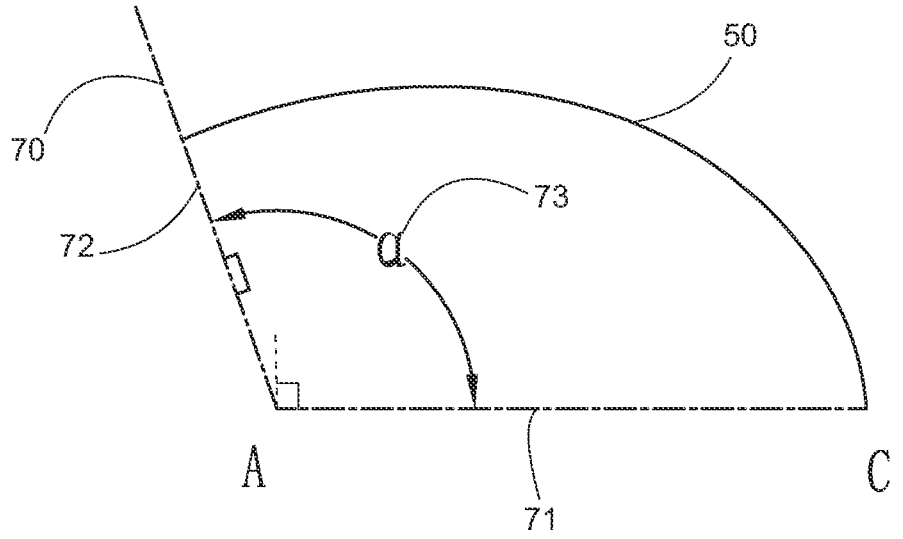
FIG. 5 shows an angle diagram for the strip orientation plane.

As seen in FIG. 5, the strip orientation plane 72 makes an angle with the housing orientation plane 71 in a geometric configuration 70. The housing orientation plane 71 and the strip orientation plane 72 have a strip orientation angle 73 between them which is greater than 90° such that the strip orientation angle 73 is an obtuse angle. The strip orientation angle 73 is preferably between 90 and 145 degrees. The obtuse angle of the strip orientation angle 73 conforms to the reflector panel 50 because the reflector panel channel profile extends from the housing orientation plane 71 to the strip orientation plane 72.

Figure 6:
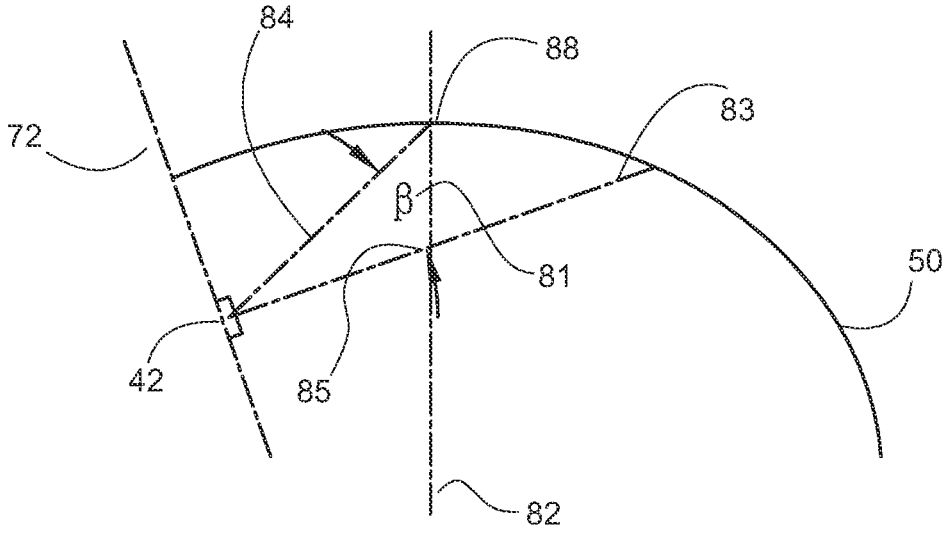
FIG. 6 shows an angle diagram for the LED chip apex line.

As seen in FIG. 6, the reflector panel 50 has a reflector apex 88 which is a vertex at an upper extent of the reflector panel 50. The LED chip 42 is a rectangular or flat electronic component that is mounted to the LED strip. The strip orientation plane 72 is normal and at a right angle to an LED chip midline 83. The LED chip midline 83 extends from the central point of the LED chip 42. The LED chip 42 is preferably symmetrical in light output so that the LED chip midline 83 is the middle of the light output pattern. The reflector apex 88 is illuminated by the LED chip 42 at the LED chip apex line 84. The LED chip apex line 84 extends from the LED chip 42 to the reflector apex 88. A reflector apex midline 82 extends downwardly from the reflector apex 88. The reflector apex midline 82 crosses the LED chip midline 83 at a midline junction 85. The LED chip apex extended line 84 and the LED chip midline 83 form a reflector apex angle 81. The reflector apex angle 81 is acute and preferably approximately 25°±25° but can be between 0 to 45 degrees depending on the shape of the reflector. It has good efficiency in the range between 0° to 45°. Optionally, the LED chip can be a central luminous point instead of a plurality of LED chips.

Figure 7:
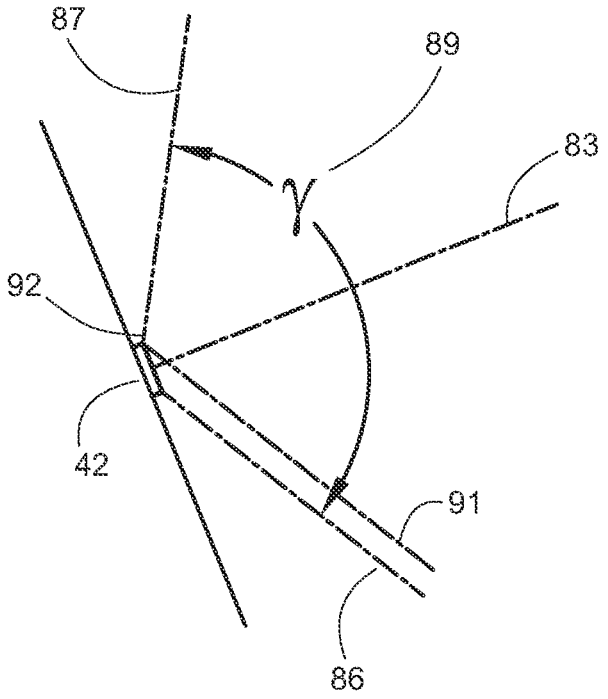
FIG. 7 shows an angle diagram for the left and right emission lines.

As seen in FIG. 7, the left emission line 87 and the right emission line 86 form an emission angle 89 between them. The LED chip 42 has an LED chip right corner and an LED chip left corner 92. The LED chip left corner also emits light and forms a right side of left corner emission line 91 that is parallel to the right emission line 86. The LED chip midline 83 preferably has the most light directed to it, while the light near the left emission line 87 and the right emission line 86 are at a much lower intensity.

Figure 8:
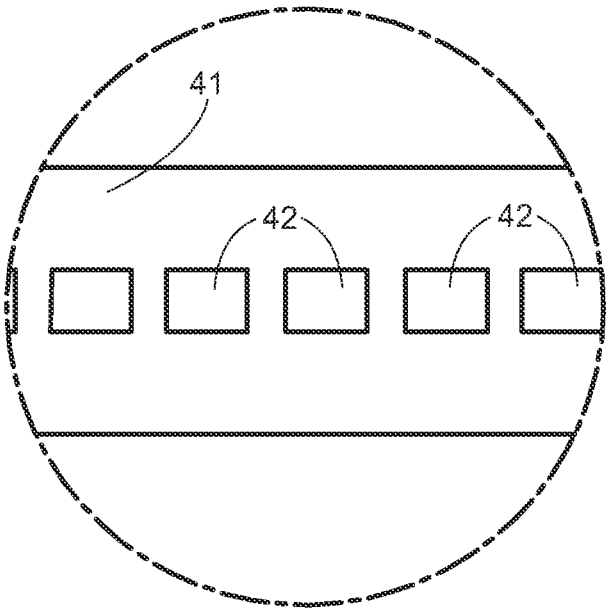
FIG. 8 shows a close-up view of the LED strip.

As seen in FIG. 8, the physical LED chips 42 are formed as small squares or rectangles mounted to a printed circuit board of the LED strip 41.

Figure 9:
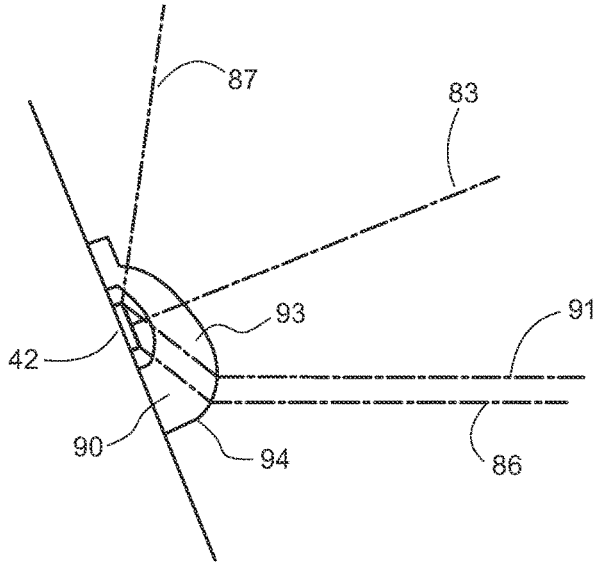
FIG. 9 shows a cross-section diagram of a contour lens.

As seen in FIG. 9, the LED chip 41 can optionally receive a contour lens 90 formed over or installed over the LED chip 41. The contour lens 90 preferably includes a lens extension 93 which has a lens extension contour 94. The lens extension contour 94 refracts or reflects the right side of left corner emission line 91 and the right emission line 86 so that they are parallel to the housing orientation plane 71 which allows more light to be directed toward the reflector. Although the LED chip midline 83 is unchanged with the contour lens 90, the lens extension 93 moves the light so that it contacts the reflector. A wide variety of different contour lens shapes can be provided to have different degrees and range of light lines and beams to fit different lighting. The method of adding lenses is optional and in most practical designs unnecessary.

Figure 10:
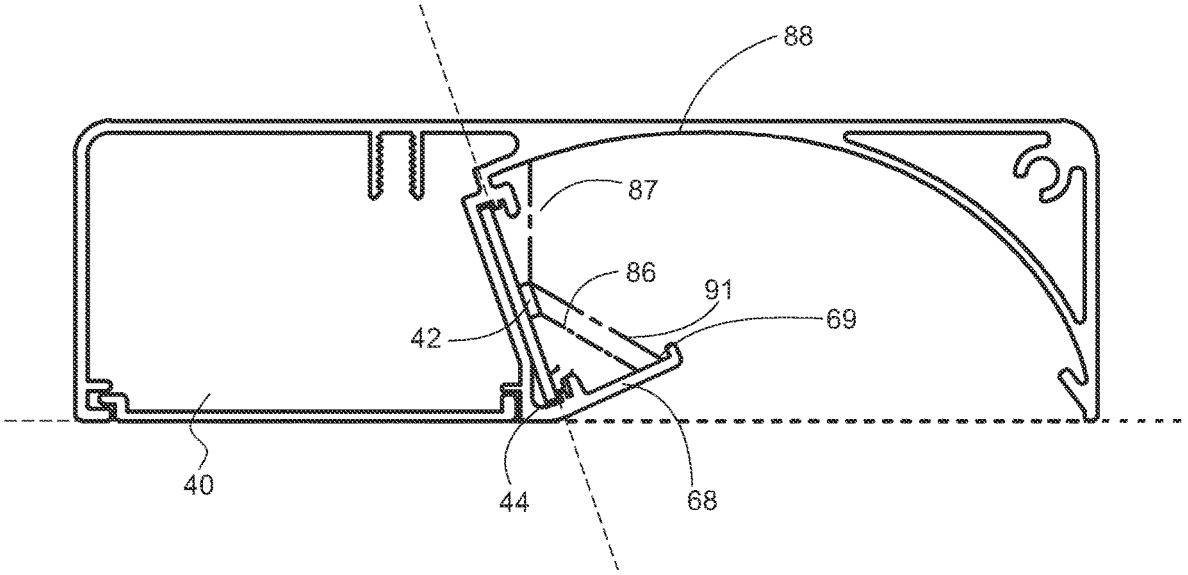
FIG. 10 shows a cross-section diagram of the LED chip with left and right emission lines.

As seen in FIG. 10, the reflector apex 88 is above the LED chip 42 and above the left emission line 87 and the right emission line 86. A power supply 40 can be included in the housing channel. The lower edge of LED strip 44 and the upper edge of LED strip lodge into the slots formed on the main body 20 for retaining the LED strip. The shading panel 68 help to block the direct light from the LED strip 41. The light emission line of right side of left corner 91 can't over the shading panel extension tip 69. In this way, the shading panel extension tip 69 completely blocks the direct light from the LED chip 42 to achieve the effect of indirect lighting.

Figure 11:
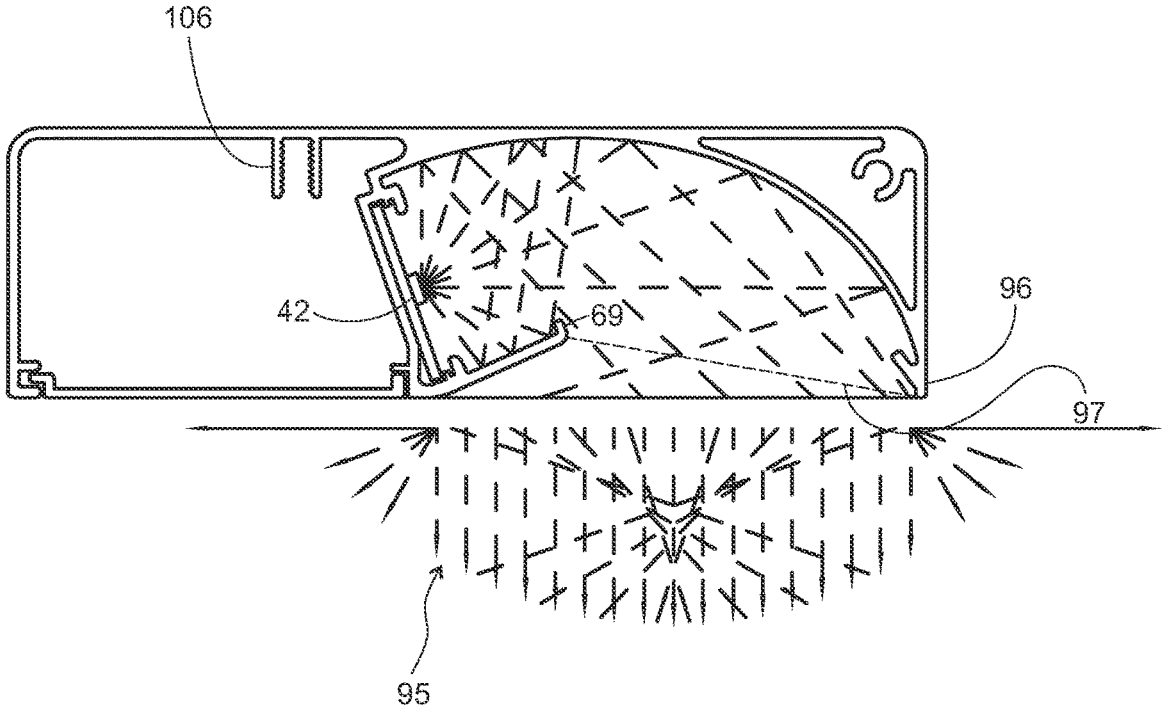
FIG. 11 shows a cross-section diagram of an LED chip.

As seen in FIG. 11, the shading panel extension tip 69 casts a cast shadow along an extension tip should line 97. The main body shade tip 96 formed on the distal portion of the main body 20, provides a shade from direct light emitted from the LED chip 42. All outgoing light is therefore indirect regardless of whether or not optical lenses or diffusers are installed on the LED strip.

The main body shade tip 96 makes an extension tip shade line 97 with the shading panel extension tip 69. The indirect nature of the lighting produces a relatively soft light profile 95 that is relatively symmetrical and even.

Figure 12:
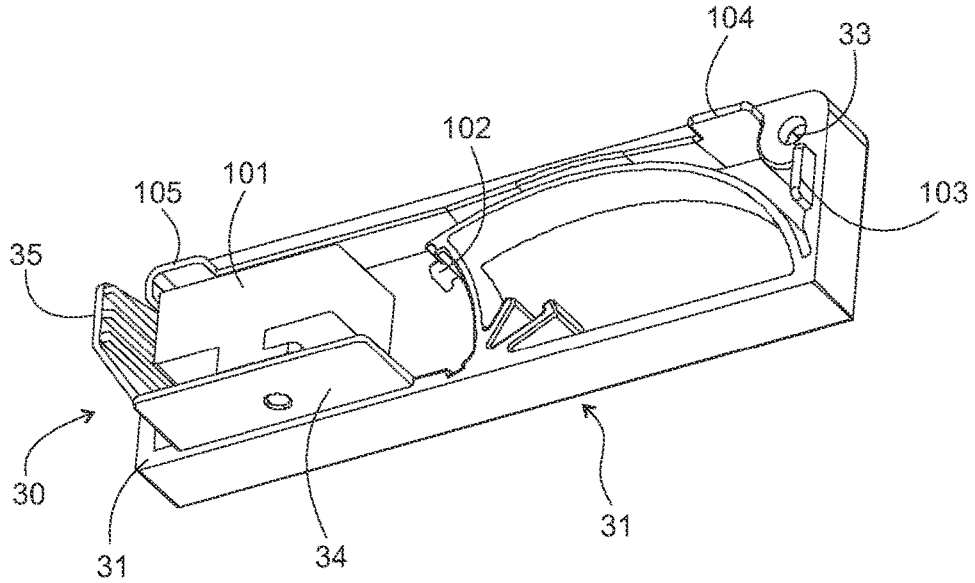
FIG. 12 shows a perspective view of the right end cap.

As seen in FIG. 12, the end cap 30 has a connector opening 33 for connection with the screw connector channel 28. The end cap is preferably plastic molded for fitting to the end of the aluminum extrusion. The end cap 30 is the right end cap 31 and the left end cap on the left side is generally symmetrical. Both end caps 30 can include an electrical connector 101 to allow daisy chaining. The end cap 30 further includes retainers that protrude into the aluminum extrusion of the main body 20. The front retainer tab 103 extends from the front of the end cap 30, and the top retainer tab 104 extends from the top of the end cap 30. The rear retainer tab 105 is preferably formed in the upper corner, while the short connector flange 35 latches to a rear side wall of the main body 20. The long connector flange 34 extending into a lower portion of the main body 20 can provide a screw opening for receiving a threaded connection to the cover panel 20 so that the cover panel 20 secures to the long connector flange 34. The end cap 30 also includes a PCB end slot 102.

The invention claimed is:

1. An indirect lighting fixture comprising:

a. a main body;

b. an LED strip having a plurality of LED chips mounted to the LED strip, wherein the LED strip is mounted at a strip orientation plane;

c. a reflector, wherein the reflector has a reflector channel profile, wherein the reflector channel profile extends between a strip orientation plane and a housing orientation plane;

d. a housing orientation plane defined on a horizontal plane;

e. a strip orientation plane defined according to the LED strip;

f. a strip orientation angle defined between the housing orientation plane and the strip orientation plane, wherein the strip orientation angle is between 90 and 145 degrees, the strip orientation angle varies according to the reflector depth; and a shading panel design, wherein the reflector panel has a reflector apex, wherein the strip orientation plane is at a right angle to an LED chip midline, wherein the reflector apex is illuminated by the LED chip at an LED chip apex line, wherein the LED chip apex line extends from the LED chip to the reflector apex, wherein the LED chip apex extended line and the LED chip midline form a reflector apex angle, wherein the reflector apex angle is acute and 25°±25°.

2. The indirect lighting fixture of claim 1, further including:

a. a strip backer panel, wherein the LED strip is mounted to the strip backer panel, wherein the LED strip is parallel to the strip backer panel b. a reflector is made by the plastic material with reflecting and diffusing character.

3. The indirect lighting fixture of claim 1, wherein the horizontal plane is parallel to the main body, wherein the main body has a horizontal lower surface.

4. The indirect lighting fixture of claim 1, further optionally including a contour lens having a lens extension, wherein the lens extension includes a lens extension contour, wherein the lens extension contour redirects a right emission line extending from the LED chip to the reflector surface.

5. The indirect lighting fixture of claim 1, wherein the main body further optional includes a secondary reflector panel, wherein the shading panel is angled upwardly and extends away from a lower edge of the LED strip.

6. An indirect lighting fixture comprising:

a. a main body;

b. an LED strip having a plurality of LED chips mounted to the LED strip, wherein the LED strip is mounted at a strip orientation plane;

c. a reflector, wherein the reflector has a reflector channel profile, wherein the reflector channel profile extends between a strip orientation plane and a housing orientation plane;

d. a housing orientation plane defined on a horizontal plane;

e. a strip orientation plane defined according to the LED strip;

f. a strip orientation angle defined between the housing orientation plane and the strip orientation plane, wherein the strip orientation angle is between 90 and 145 degrees, the strip orientation angle varies according to the reflector depth; and a shading panel design, further optionally including a shade adjacent to the LED strip and opposing the reflector, wherein light emitted from the LED chips does not directly emit to the reflector surface, and be diffused by the shade.

7. The indirect lighting fixture of claim 6, further including:

a. a strip backer panel, wherein the LED strip is mounted to the strip backer panel, wherein the LED strip is parallel to the strip backer panel, b. a reflector is made by the plastic material with reflecting and diffusing character.

8. The indirect lighting fixture of claim 6, wherein the horizontal plane is parallel to the main body, wherein the main body has a horizontal lower surface.

9. The indirect lighting fixture of claim 6, further optionally including a contour lens having a lens extension, wherein the lens extension includes a bulb extension contour, wherein the lens extension contour redirects a right emission line extending from the LED chip to the reflector surface.

10. The indirect lighting fixture of claim 6, wherein the main body further optionally includes a secondary reflector panel, wherein the shading panel is angled upwardly and extends away from a lower edge of the LED strip.

11. The indirect lighting fixture of claim 6, wherein the reflector channel profile has a reflector apex, wherein the strip orientation plane is at a right angle to an LED chip midline, wherein the reflector apex is illuminated by the LED chip at an LED chip apex line, wherein the LED chip apex line extends from the LED chip to the reflector apex, wherein the LED chip apex extended line and the LED chip midline form a reflector apex angle, wherein the reflector apex angle is acute and 25°±25°.

12. The indirect lighting fixture of claim 11, further including:

a. a strip backer panel, wherein the LED strip is mounted to the strip backer panel, wherein the LED strip is parallel to the strip backer panel, b. a reflector panel is made by the plastic material with reflecting and diffusing character.

13. The indirect lighting fixture of claim 11, wherein the horizontal plane is parallel to the main body, wherein the main body has a horizontal lower surface.

14. The indirect lighting fixture of claim 11, further optionally including a contour lens having a lens extension, wherein the lens extension includes a lens extension contour, wherein the lens extension contour redirects a right emission line extending from the LED chip to the reflector panel surface.

15. The indirect lighting fixture of claim 11, wherein the main body further optionally includes a secondary reflector panel, wherein the shading panel is angled upwardly and extends away from a lower edge of the LED strip.

* * * * *